US010395635B2

(12) United States Patent
Yee et al.

(10) Patent No.: US 10,395,635 B2
(45) Date of Patent: Aug. 27, 2019

(54) REDUCING RADIO FREQUENCY SUSCEPTIBILITY IN HEADSETS

(71) Applicant: Bose Corporation, Framingham, MA (US)

(72) Inventors: Lee John Yee, Newton, MA (US); Nathan Marshall Cross, Stow, MA (US)

(73) Assignee: BOSE CORPORATION, Framingham, MA (US)

( * ) Notice: Subject to any disclaimer, the term of this patent is extended or adjusted under 35 U.S.C. 154(b) by 48 days.

(21) Appl. No.: 15/694,148

(22) Filed: Sep. 1, 2017

(65) Prior Publication Data

US 2018/0012586 A1 Jan. 11, 2018

Related U.S. Application Data

(63) Continuation of application No. 15/162,898, filed on May 24, 2016, now Pat. No. 9,799,319.

(51) Int. Cl.
*H04R 3/00* (2006.01)
*G10K 11/178* (2006.01)

(52) U.S. Cl.
CPC ..... *G10K 11/178* (2013.01); *H04R 3/00* (2013.01); *G10K 2210/1081* (2013.01); *H04R 2410/00* (2013.01)

(58) Field of Classification Search
CPC ..... G10K 11/178; G10K 2210/1081; H04R 3/00; H04R 2410/00
USPC ..... 381/71.6
See application file for complete search history.

(56) References Cited

U.S. PATENT DOCUMENTS

| | | | | |
|---|---|---|---|---|
| 220,791 | A | 10/1879 | Bell | |
| 244,426 | A | 7/1881 | Bell | |
| 7,173,189 | B1 * | 2/2007 | Hazy | H01B 11/04 174/110 R |
| 7,499,555 | B1 | 3/2009 | Isvan | |
| 8,090,123 | B2 * | 1/2012 | Chen | H04R 19/016 381/113 |
| 9,799,319 | B1 * | 10/2017 | Yee | G10K 11/178 |
| 2008/0247580 | A1 * | 10/2008 | Jang | H04R 25/505 381/323 |
| 2010/0215198 | A1 | 8/2010 | Ngia et al. | |
| 2010/0310096 | A1 | 12/2010 | Josefsson et al. | |
| 2012/0275527 | A1 * | 11/2012 | Douglass | H04L 25/0272 375/257 |
| 2016/0119704 | A1 * | 4/2016 | Brown | H04R 1/1091 381/309 |

(Continued)

OTHER PUBLICATIONS

Non-Final Office Action in U.S. Appl. No. 15/162,898, dated May 24, 2017; 9 pages.

(Continued)

*Primary Examiner* — Hemant S Patel
(74) *Attorney, Agent, or Firm* — Schmeiser, Olsen & Watts LLP; Timothy P. Collins

(57) ABSTRACT

A headset includes a microphone that detects an acoustic signal, and converts the acoustic signal into a microphone signal, an audio processor that receives the microphone signal, and a twisted pair conductor element coupling the microphone and the audio processor. The twisted pair conductor element self-cancels a radio frequency (RF) field to prevent the RF field from entering the microphone.

18 Claims, 9 Drawing Sheets

(56) References Cited

U.S. PATENT DOCUMENTS

2016/0125869 A1 5/2016 Kulavik et al.

OTHER PUBLICATIONS

Notice of Allowance in U.S. Appl. No. 15/162,898, dated Jul. 3, 2017; 5 pages.
International Search Report and Written Opinion in International Patent Application No. PCT/US17/28869, dated Jul. 6, 2017; 13 pages.
International Preliminary Report on Patentability in PCT/US2017/028869 dated Dec. 6, 2018; 9 pages.

* cited by examiner

REDUCING RADIO FREQUENCY SUSCEPTIBILITY IN HEADSETS

RELATED APPLICATIONS

This application is a continuation application and claims the benefit of U.S. patent Ser. No. 15/162,898 filed May 24, 2016, entitled "Reducing Radio Frequency Susceptability in Headsets," the contents of which are incorporated by reference herein in their entirety.

BACKGROUND

This description relates generally to communication headsets, and more specifically, to systems and methods for reducing stray radio frequency (RF) fields in headsets.

BRIEF SUMMARY

In accordance with one aspect, a headset comprises: a microphone that detects an acoustic signal, and converts the acoustic signal into a microphone signal; an audio processor that receives the microphone signal; and a twisted pair conductor element coupling the microphone and the audio processor, wherein the twisted pair conductor element self-cancels a radio frequency (RF) field to prevent the RF field from entering the microphone.

Aspects may include one or more of the following features:

The headset may be a wireless active noise reduction (ANR) headset.

The headset may be a consumer, military or aviation headset.

The twisted pair conductor element may comprise a pair of flexible non-shielded conductive wires.

The pair of conductive wires may be of approximately equal lengths.

The headset may further comprise a reverse biasing circuit coupled to the twisted pair conductor element.

The reverse biasing circuit may reduce RF susceptibility of the twisted pair conductor element.

The reverse biasing circuit may comprise a microphone bias voltage input at a first wire of the twisted pair conductor element; an RC circuit coupled to a second wire of the twisted pair conductor element; an amplifier including a first input terminal coupled to the RC circuit and a second input terminal coupled to a voltage source; and an output terminal of the amplifier that outputs a voltage from the amplifier in response to signals received at the first and second input terminals.

The reverse biasing circuit may reduce RF susceptibility of the twisted pair conductor element by decoupling the microphone bias voltage input from a resistor of the RC circuit.

The reverse biasing circuit may decrease an impedance of a conductor in the twisted pair conductor element, thereby reducing capacitively coupled noise from the RF field.

The reverse biasing circuit may decrease an impedance of an input line of the twisted pair conductor element that most effects circuitry associated with the microphone, which may reduce the capacitively coupled noise from the RF field.

The microphone may be a condenser microphone, an electret microphone, a microelectromechanical (MEMS) microphone, a dynamic microphone, a carbon microphone, a ribbon microphone or a crystal microphone.

The twisted pair conductor element may be unshielded.

In accordance with another aspect, a headset comprises a sensing microphone that detects an acoustic signal, and converts the acoustic signal into a microphone signal; an audio processor that receives the microphone signal; a conductor element coupled between the sensing microphone and the audio processor for transmitting the microphone signal from the sensing microphone to the audio processor; and a reverse bias circuit coupled to the conductor element for reducing a stray ambient radio frequency (RF) field that enters the element during an exchange of the microphone signal between the sensing microphone and the audio processor.

Aspects may include one or more of the following features:

The headset may be a wireless active noise reduction (ANR) headset.

The headset may be a consumer, military or aviation headset.

The conductor element may comprise a non-shielded twisted pair conductive wire for further reducing the stray RF field that enters the element.

The reverse bias circuit may decrease an impedance of an input line of the twisted pair conductive wire that most effects circuitry associated with the microphone, which may reduce capacitively coupled noise from the stray ambient RF field.

The conductor element may comprise a coaxial shielded cable and a metal microphone housing about the microphone.

The reverse bias circuit may decrease an impedance of an input line of the coaxial shielded cable that most affects circuitry associated with the microphone, which may reduce capacitively coupled noise from the stray ambient RF field.

The reverse bias circuit may comprise a microphone bias voltage input at a first wire of the conductor element; an RC circuit coupled to a second wire of the conductor element; an amplifier including a first input terminal coupled to the RC circuit and a second input terminal coupled to a voltage source; and an output terminal of the amplifier that outputs a voltage from the amplifier in response to signals received at the first and second input terminals.

By decoupling the microphone bias voltage input from a resistor of the RC circuit, the reverse bias circuit may reduce the stray ambient RF field in the conductor element.

The reverse bias circuit may decrease an impedance of a conductor in the conductor element, thereby reducing capacitively coupled noise from the stray ambient RF field.

In another aspect, a circuit between a microphone and an audio processor of a headset for reducing stray radio frequency (RF) fields comprises a first wire and a second wire in a twisted pair arrangement; and a reverse biasing circuit coupled to the first and second wires for optimizing impedances on the first and second wires.

The reverse biasing circuit may comprise a microphone bias voltage input directly coupled to the first wire and an RC circuit directly coupled to the second wire.

BRIEF DESCRIPTION

The above and further advantages of examples of the present inventive concepts may be better understood by referring to the following description in conjunction with the accompanying drawings, in which like numerals indicate like structural elements and features in various figures. The drawings are not necessarily to scale, emphasis instead being placed upon illustrating the principles of features and implementations.

DETAILED DESCRIPTION

A headset refers to a device that fits around, on, or in an ear and that radiates acoustic energy into the ear canal. Headsets are sometimes referred to as earphones, earpieces, headphones, earbuds or sport headphones, and can be wired or wireless. A headset includes an acoustic driver to transduce audio signals to acoustic energy. The acoustic driver may be housed in an earcup or earbud. A headset may have a single stand-alone headphone or be one of a pair of headphones (each including a respective acoustic driver and earcup), one for each ear. The earcups/earbuds of a headset may be connected mechanically, for example by a headband and/or by leads that conduct audio signals to an acoustic driver in the headphone, or they may be completely wireless. A headset may include components for wirelessly receiving audio signals. A headset may include components of an active noise reduction (ANR) system, but is not limited thereto. A headset may also include other functionality such as a communications microphone so that it can function as a communication device.

Headsets may have susceptibility to radio frequency (RF) signals from external or internal sources of RF energy such as wireless transmitters, radio stations, and so on, which can affect the internal microphone circuitry and operation of the headset. In particular, stray RF fields may cause the internal circuitry of the microphone to produce an undesired signal, which can result in audible artifacts (e.g., a buzzing sound, tone, etc.) in the audio output signal. In an ANR headset in particular, stray RF fields can further cause an inaccurate response whereby the audio circuit cannot perform an effective noise cancelation of the headset.

Figure 1:
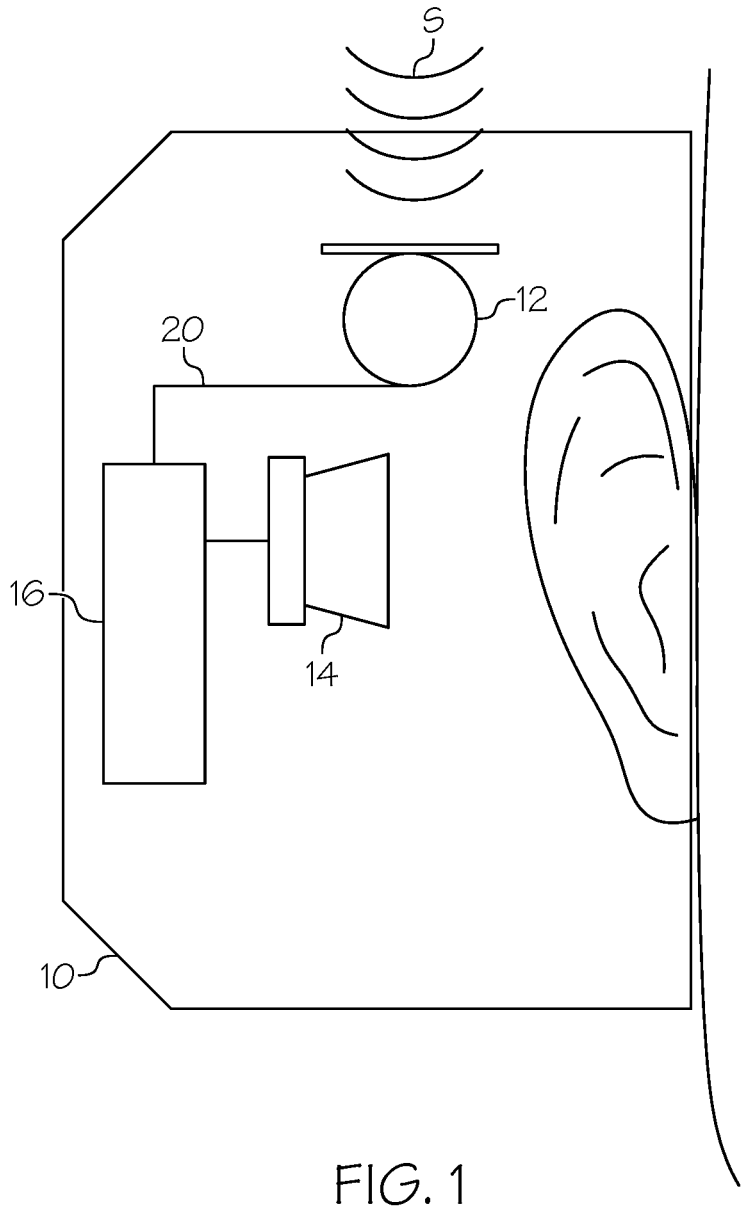
FIG. 1 is a schematic cross-sectional diagram illustrating the configuration of a headset, in accordance with some examples.

As shown in FIG. 1, a headset 10 in accordance with some examples may include a sensing microphone 12, a speaker 14, or related transducer or driver, and a set of electronics 16 for performing audio processing, referred to as an audio processor. In some examples, the headset 10 may be a wireless headset, and therefore includes wireless components such as a wireless receiver, antenna, Bluetooth® interface, and/or other related wireless elements, some or all of which may be a source of stray RF which may affect microphone performance. In some examples, the headset 10 is an active noise reduction (ANR) headset. In some examples, the headset 10 is constructed for a consumer, military or aviation application. Although one microphone is shown in FIG. 1, multiple microphones may be used, for example in a feedback and/or feedforward configuration of an ANR headset.

The sensing microphone 12 detects an acoustic signal S, and converts the acoustic signal into a microphone signal. The acoustic signal may be a noise signal in the case of an ANR headset, or it may be a voice or other audio signal in a non-ANR headset. The sensing microphone 12 may be positioned at or near an electro-acoustic transducer diaphragm over a front cavity of the headphone's transducer for picking up a frequency and amplitude profile at an instant in time. The sensing microphone 12 may be positioned at other locations, for example, at or near a wearer's ear canal, external to the housing, or proximal to digital electronics or RF transmitters, but not limited thereto.

The audio processing electronics 16 are constructed and arranged to receive and process the microphone signal, for example, in the case of an ANR headset, producing an "anti-noise signal" that can provide canceling sound waves that can be combined or mixed with existing ambient noise for output by the speaker 14 to reduce the overall noise level. The audio processing electronics 16 may be part of a microcontroller, microprocessor, digital signal processor (DSP), printed circuit board (PCB) or the like. In some examples, the audio processor 16 comprises an ANR circuit. In some examples, the microphone 12 is a condenser or electret microphone or similar microphone, but is not limited thereto. In other examples, the microphone 12 can be a microelectromechanical (MEMS) microphone, dynamic microphone, carbon microphone, ribbon and crystal microphones, or any microphone that is sensitive to RF signals.

Figure 2:
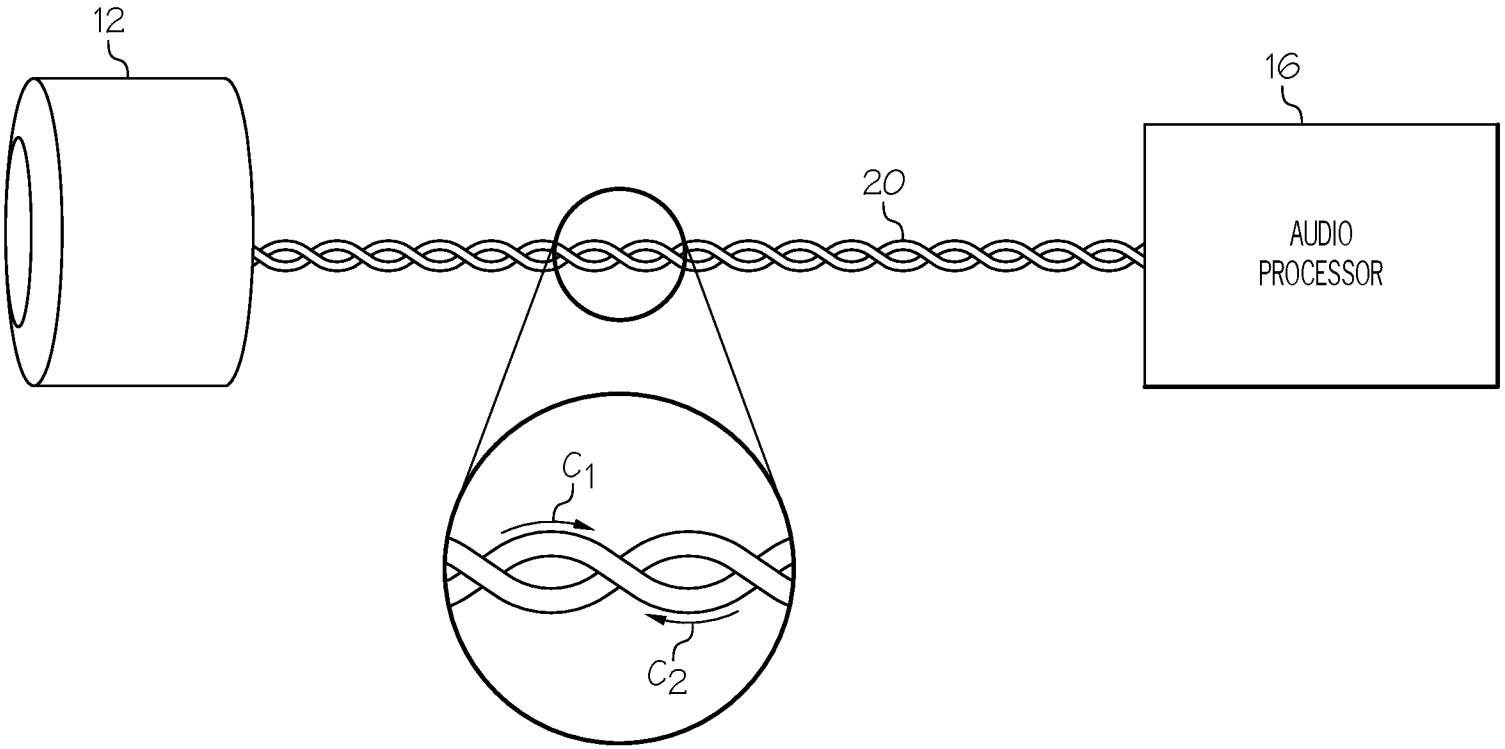
FIG. 2 is an illustrative diagram of components of the headset of FIG. 1.

The headset 10 may further include a conductor element 20 coupled between the microphone 12 and the audio processor 16. As shown in FIG. 2, in an example, the conductor element 20 includes a twisted pair cable that self-cancels or otherwise reduces a stray ambient radio frequency (RF) field that enters the twisted pair conductor element 20 during a signal exchange between the sensing microphone 12 and the audio processor 16. The twisted pair cable may be soldered or otherwise conductively coupled to the microphone 12.

A feature of the twisted pair conductor element 20 is that the wires forming the pair may be of a finer gauge than that of conventional conductive wires, since the shielding properties are not dependent on the wire construction dimension. A shielded coaxial cable on the other hand has a shielding effectiveness that is directly related to the thickness of the braided covering and how fine the mesh of the braid is. Therefore, a denser mesh translates to an improved shielding effect. In addition, conventional coaxial cable that is frequently used in headsets often includes an additional foil layer (making the cable double-shielded) to improve the shielding property of the coaxial cable. The need to provide a coaxial cable with adequate shielding makes the coaxial cable rigid, which makes it difficult to route and difficult to solder to the microphone due to the coaxial cable's large diameter. By using a twisted pair conductor element, which may use a finer gauge wire and may not require additional shielding, these issues can be mitigated.

As previously mentioned, in some examples, a twisted pair conductor element 20 may be at least partially shielded. Here, stray RF fields can enter the twisted pair conductor element 20, via, for example, areas of the conductor element that are exposed or unshielded. The twisted pair arrangement may include two conductors, for example, of substantially equal lengths and/or of other same or similar dimensions. The conductors may be physically twisted about each other through one or more turns, such that both conductors are exposed to the same induced RF noise conditions when the RF passes through one loop of the twisted cable which is then cancelled by the similarly generated induced current that is traveling in the opposite direction by the adjacent twisted pair loop. The conductor element 20 may have a predetermined twist rate or pitch constructed for effectively reducing or eliminating stray RF fields that may otherwise be imposed on the microphone 12. When constructed and arranged in this manner as a balanced pair, the two wires have equal and opposite currents flowing there through, for example, currents c1 and c2 shown in FIG. 2. When RF noise-related signals are introduced to the conductor element 20, they couple to both wires equally (but in opposite directions), producing a differential-mode signal which can be canceled within each "twist" at the conductor element 20, before ever reaching the microphone element 12. In some examples, the twisted pair may include a flexible non-shielded twisted pair wire, for example, 30 American Wire Gauge (AWG). In alternative examples, the twisted pair may be shielded or at least partially shielded via a coaxial or similar covering cable. A typical length of the conductor element 20 between the microphone element 12 and the audio processor 16 may be about 6 cm, but depends on the application, and is not limited thereto.

In some examples, the twisted pair conductor element 20 does not include shielding. Here, the twisted pair conductor 20 operates as described above, and can minimize RF on the microphone input line without a ground reference. In a typical headset that uses a conventional conductor element and does not have a ground reference, the conductor element cannot effectively prevent RF on the cable shield from capacitively coupling to the inner center conductor. With the techniques described herein, by contrast, the twisted pair conductor element 20 self-cancels the stray RF, both with or without any shielding.

Conventional approaches for routing signals to a headset microphone include a double-shielded coaxial cable coupled between the microphone and the PCB, along with a cup-shaped shield that fits over the microphone to prevent RF signals from reaching the internal circuitry of the microphone. A limitation with the use of a conventional double-shielded coaxial cable is that it is difficult to completely prevent RF signals from reaching the cable, and therefore the microphone, as there are typically some portions of the cable that are unshielded or exposed. Further, a conventional double-shielded coaxial cable is difficult to solder to the microphone and PCB due to the abovementioned inherent rigidity of the coaxial cable.

Figure 3:
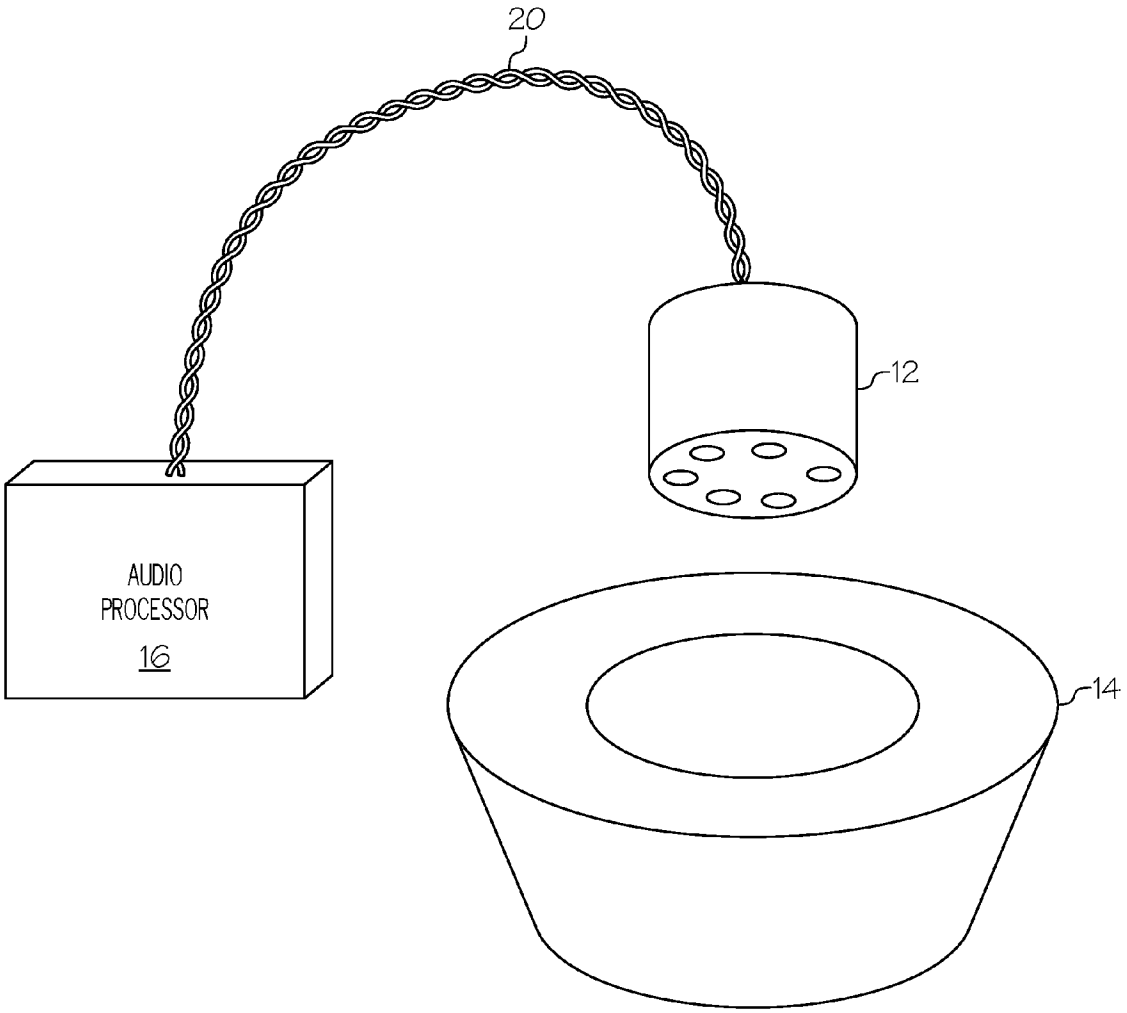
FIG. 3 is another illustrative diagram of components of the headset of FIG. 1.

The twisted pair conductor element 20 eliminates the need for both the rigid coaxial shielding cable and the cup shaped shield. As shown in FIG. 3, the conductor element 20 includes a twisted pair arrangement. At one end, each conductive wire in the pair is coupled to a terminal extending from the microphone 12, for example, by soldering or other attachment technique. At the other end, each conductive wire of the twisted pair is coupled to a terminal extending from the audio processor 16, for example, small rectangular solder pads on a PCB where the twisted pair cable is directly soldered.

Figure 4A:
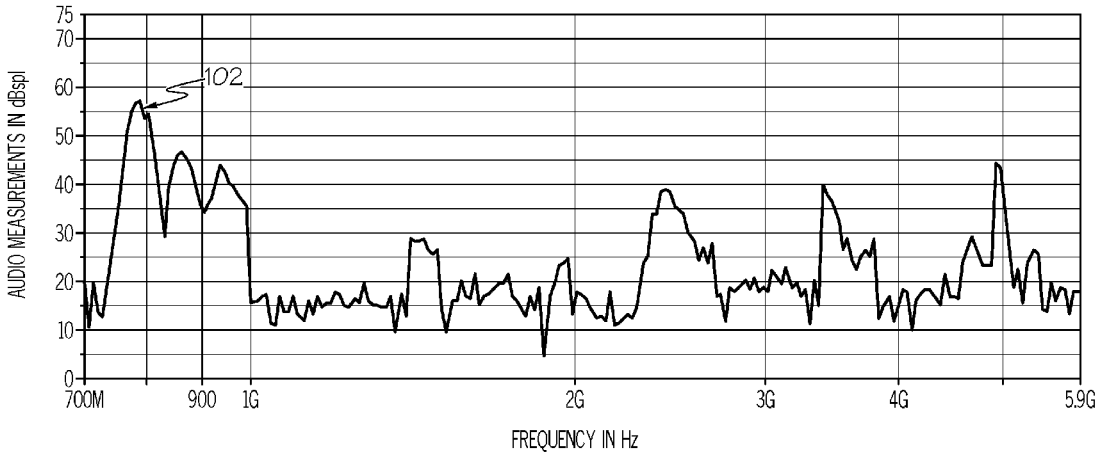
FIG. 4A is a graph illustrating a frequency response of an operating headset including a conventional coaxial cable between a microphone and an audio processor.
Figure 4B:
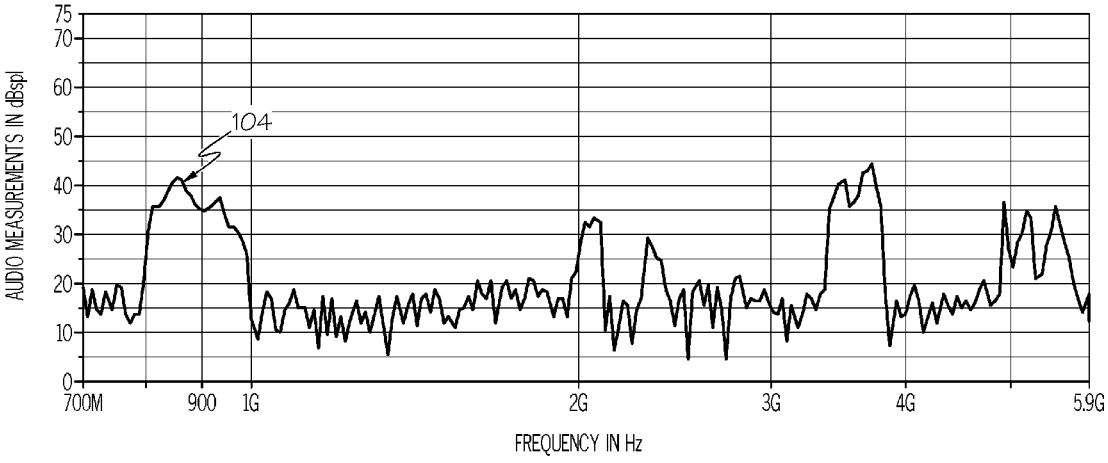
FIG. 4B is a graph illustrating a frequency response of an operating headset including a twisted pair cable between a microphone and an audio processor, in accordance with some examples.

A graphical comparison between the performance of a microphone using a conventional coaxial cable and a twisted pair cable is illustrated in FIGS. 4A and 4B, respectively. Each graph includes a frequency spectrum along the x-axis and a sound pressure level range (SPL) in decibels (dB) along the y-axis. In each graph, the detected de-modulated audio from the microphone under the presence of a stray amplitude-modulated 700 MHz to 1 GHz RF field was measured.

In the susceptibility diagram shown in FIG. 4A, a maximum processed-detected audio signal 102 from the microphone for conventional coaxial cabling between the microphone and audio processor is about 57 dBSPL. In the susceptibility diagram shown in FIG. 4B, a maximum processed-detected audio signal 104 from the microphone for twisted pair cabling between the same microphone and audio processor is about 42 dBSPL, or an approximately 15 dBSPL improvement over the configuration corresponding to the FIG. 4A frequency response. This illustrates that the twisted pair cabling is more effective at reducing and/or eliminating the presence of any stray RF field as detected at the microphone.

Figure 5:
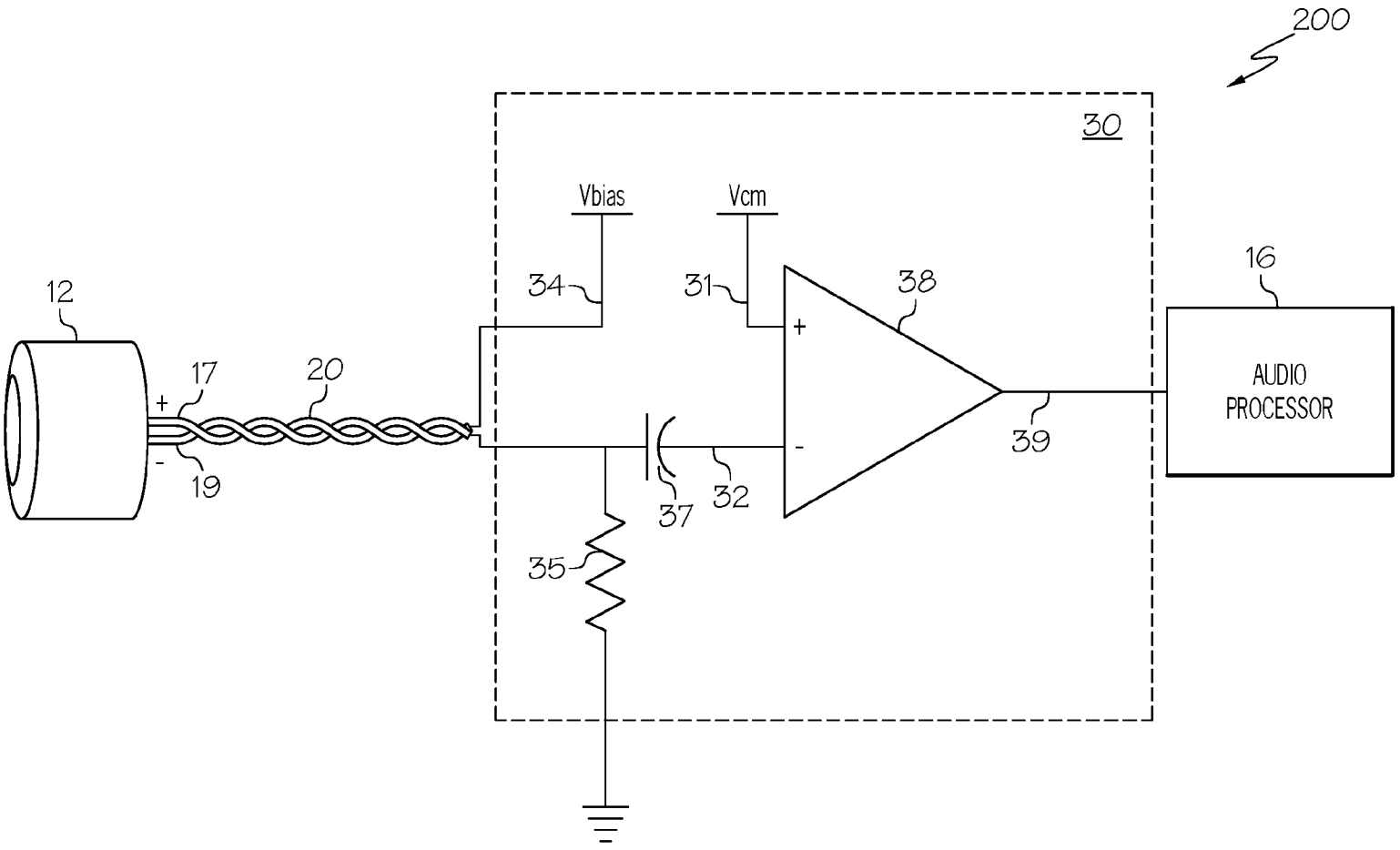
FIG. 5 is a detailed schematic view of a headset including a reverse biasing circuit, in accordance with some examples.

FIG. 5 is a block diagram of a headset 200 including a reverse biasing device (or circuit) 30, an audio processor 16, and a microphone 12, in accordance with some examples. The reverse biasing device 30 is coupled between the conductor element 20 (which may be a twisted pair conductor element as described herein) and the audio processor 16. The microphone 12, conductor element 20, and audio processor 16 can be similar or the same as described in FIGS. 1-3. Details of the microphone 12, conductor element 20, and audio processor 16 are therefore not repeated for brevity.

The reverse biasing device 30 can supplement the effect on stray RF fields provided by a conductor element 20 having a twisted pair configuration. The reverse biasing device 30 can also be used to mitigate the effect of stray RF fields in a headset with a microphone having a conventional coaxial cable (or other type of cable) connecting the microphone to the processing device. The reverse biasing device 30 may include an amplifier 38 having a first input terminal 31 a second input terminal 32, and an output terminal 39, a voltage source (Vcm) coupled to the first input terminal 31, and a resistor-capacitor (RC) circuit comprising a resistor 35 and capacitor 37 coupled to the second input terminal 32

As shown in FIG. 5, the conductor element 20 may include a twisted pair arrangement, for example as described in FIGS. 1-3. The first input terminal 31 of the amplifier 38 may be directly connected to a voltage source (Vcm), for example, an operational amplifier voltage bias. A voltage source input (Vbias) 34, or microphone bias voltage may be directly coupled to a first wire in the twisted pair 20. In some examples, the microphone bias voltage Vbias may range from 1-30V. In some examples, Vcm=Vbias/2. The second input terminal 32 to which the RC circuit 35, 37 is coupled may be directly coupled to the second wire in the twisted pair 20. In doing so, the reverse biasing device 30 decreases the RF impedance of the input line of the twisted pair conductor element 20 that directly connects to the microphone positive termination pad 17. RF impedance on the microphone positive termination pad 17 can affect the internal microphone circuitry once inside the microphone's metallic housing. Thus, decreasing the RF impedance of this wire results in a reduction in capacitively coupled noise from stray ambient RF fields. In other words, the reverse bias circuit 30 decreases the RF impedance of an input line of a twisted pair cable element that most effects the internal microphone circuitry, which reduces capacitively coupled noise from the stray ambient RF field. Moving the resistor of the RC circuit to the microphone negative line 19 does not cause an adverse effect because the negative line connects directly to the microphone metallic housing. In addition, the electromagnetic skin-effect phenomena causes any coupled RF on the negative line to stay on the outside of the microphone housing and not appear inside the housing where it can interfere with the internal microphone circuitry. In particular, for capacitively coupled noise, i.e., the electric component, the ratio of noise voltage to signal voltage is reduced when the RF circuit impedance is reduced. A microphone 12 configured for a particular sensitivity that is sensitive to stray RF fields, can operate effectively, i.e., detect ambient noise, voice or other acoustic signals, notwithstanding the presence of stray RF.

A related feature is that the sensitive microphone positive line 17, which is coupled to the twisted pair cable 20 (FIG. 5) and/or coaxial cable 20" (FIG. 6), has a decreased impedance because the RC circuit 35, 37 has been decoupled from the microphone bias voltage source (Vbias) and instead coupled to the other conductor element within the cable, which reduces stray electromagnetic RF energy or any capacitively coupled noise, for example, from moving within the coaxial cable 20.

Figure 6:
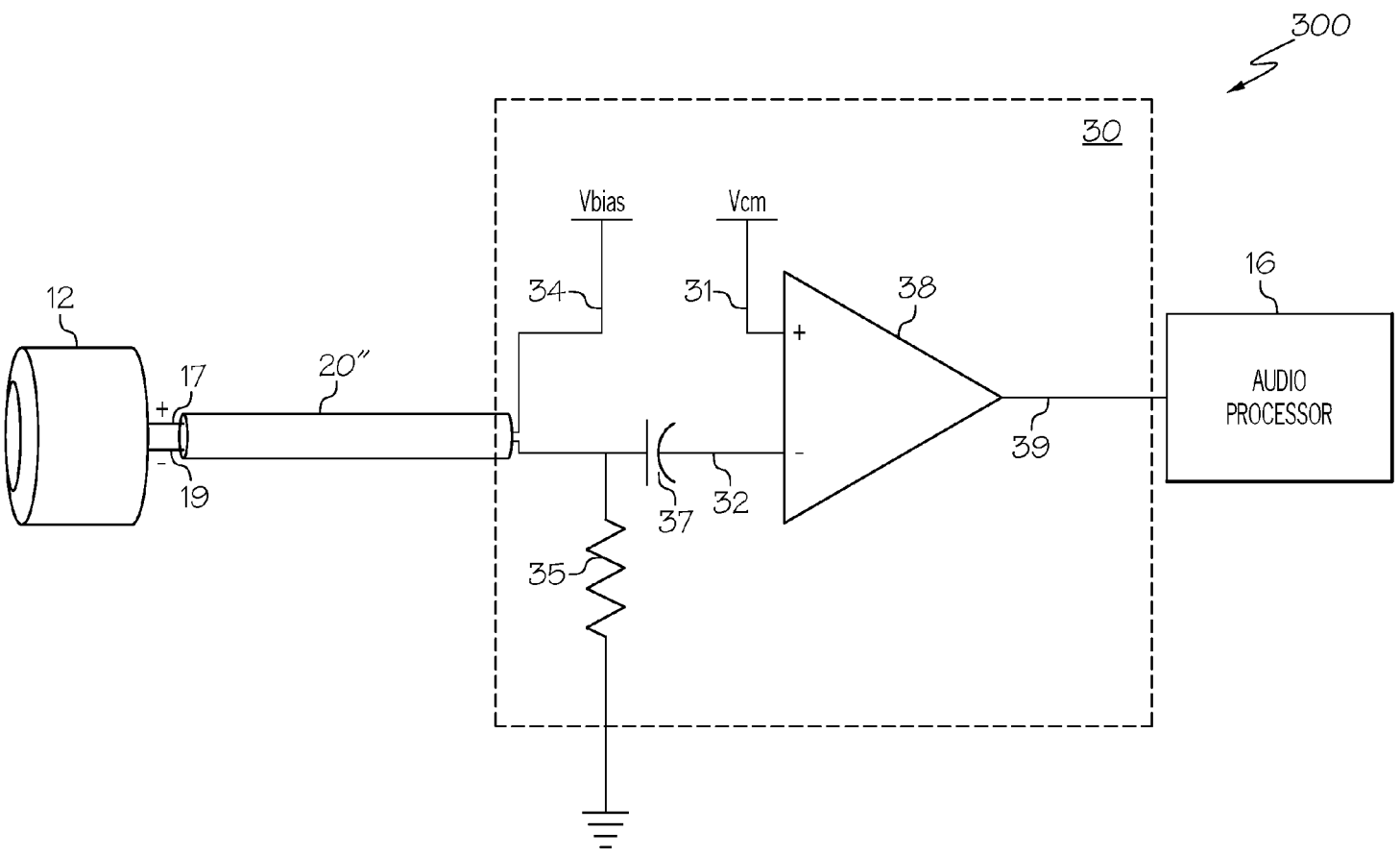
FIG. 6 is a detailed schematic view of a headset including a reverse biasing circuit, in accordance with other examples.

The headset 300 illustrated in the block diagram of FIG. 6 is similar to the headset 200 shown in FIG. 5, except that the headset 300 in FIG. 6 includes a shielded coaxial cable 20" instead of a twisted pair cable. As with the headset 200 including a twisted pair cable 20 in FIG. 5, the presence of the reverse biasing device 30 at the headset 300 in FIG. 6 reduces the impact of stray RF fields on the headset microphone. In addition, the presence of the reverse biasing device 30 improves an electromagnetic skin effect, which is the tendency of a current to concentrate its largest density near the surface of a conductive cable. Other benefits of the reverse biasing circuit described with reference to FIG. 5 equally apply.

Accordingly, the reverse biasing device 30 can lower the RF susceptibility by lowering the RF impedance on the microphone positive line regardless of whether a twisted pair wire 20 (FIG. 5) or coaxial wire (FIG. 6) extends between the microphone 12 and audio processor 16.

Figure 7A:
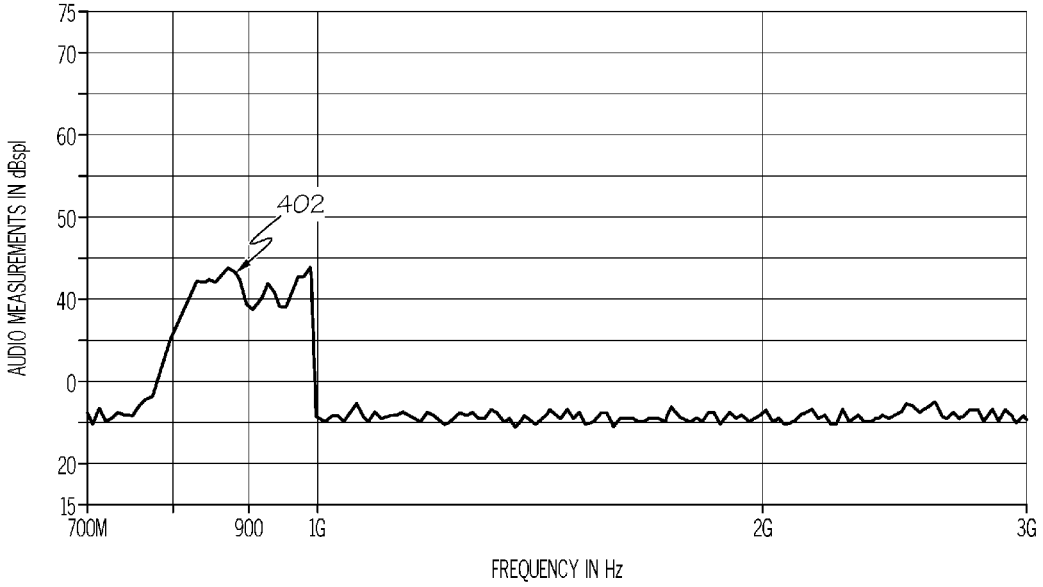
FIG. 7A is a graph illustrating a frequency response of a headset absent a reverse biasing circuit.
Figure 7B:
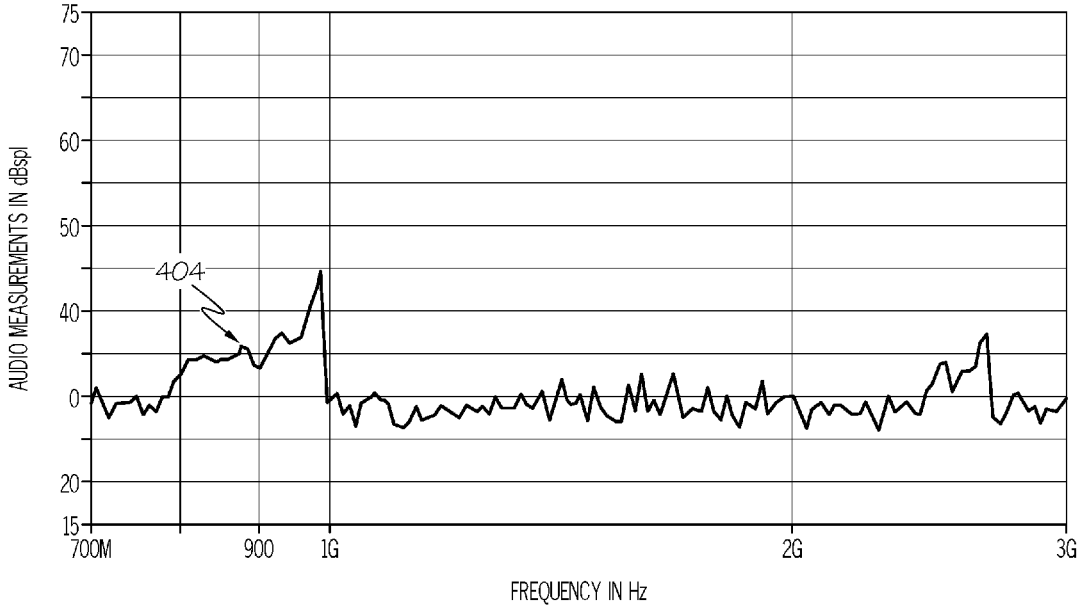
FIG. 7B is a graph illustrating a frequency response of a headset including a reverse biasing circuit, in accordance with some examples.

A graphical comparison between the performance of a microphone in a headphone having a reverse biasing device and that without a reverse biasing device is illustrated in FIGS. 7A and 7B. Each graph includes an RF frequency spectrum along the x-axis and a processed-detected audio level range (SPL) in decibels (dB) along the y-axis. In each graph, the processed-detected audio from the microphone under the presence of a stray 850 MHz RF field was measured, see regions 402 and 404 respectively.

In the frequency response diagram shown in FIG. 7A, a maximum detected audio signal 402 between a microphone and audio processor is about 44 dBSPL. The graph illustrates results of a twisted pair cable between the microphone and audio processor before a reverse biasing circuit is applied. In the frequency response diagram shown in FIG. 7B, a maximum detected audio 404 at a headphone including a reverse biasing device and twisted pair cable between the microphone and audio processor is about 34 dBSPL, or approximately a 10 dBSPL improvement over the configuration corresponding to the FIG. 7A frequency response. This illustrates that the reverse biasing circuit is more effective at reducing and/or eliminating the presence of any stray RF field as detected at the microphone.

A number of implementations have been described. Nevertheless, it will be understood that the foregoing description is intended to illustrate and not to limit the scope of the inventive concepts which are defined by the scope of the claims. Other examples are within the scope of the following claims.

What is claimed is:

1. A noise-cancelling headset, comprising:

an active noise reduction sensing microphone that detects an acoustic signal, and converts the acoustic signal into a microphone signal;

an active noise reduction circuit that receives and processes the microphone signal; and a twisted pair conductor element coupling the microphone and the active noise reduction circuit, wherein the twisted pair conductor element self-cancels a radio frequency (RF) field absent a ground reference to prevent the RF field from entering the active noise reduction sensing microphone.

2. The noise-cancelling headset of claim 1, wherein the twisted pair conductor element includes a non-shielded twisted pair cable or a partially shielded twisted pair cable.

3. The noise-cancelling headset of claim 1, wherein the twisted pair conductor element further produces a differential-mode signal that is canceled by the twisted pair conductor element to further prevent the RF field from entering the active noise reduction sensing microphone.

4. The noise-cancelling headset of claim 1, wherein at one end of the noise-cancelling headset, each conductive wire of the twisted pair conductive element is directly coupled to a terminal extending from the active noise reduction sensing microphone, and where at the other end of the noise-coupling headset, each conductive wire of the twisted pair conductive element is directly coupled to a terminal extending from a printed circuit board (PCB) of the active noise reduction circuit.

5. The noise-cancelling headset of claim 1, wherein the active noise reduction sensing microphone is at least one of a: condenser microphone, electret microphone, microelectromechanical (MEMS) microphone, dynamic microphone, carbon microphone, ribbon microphone and crystal microphone.

6. The noise-cancelling headset of claim 1, wherein the twisted pair conductor element has a twist rate or pitch constructed for reducing or eliminating the stray RF fields that may otherwise be imposed on the active noise reduction sensing microphone.

7. A noise-cancelling headset, comprising:

an active noise reduction sensing microphone that detects an acoustic signal, and converts the acoustic signal into a microphone signal;

an active noise reduction circuit that receives and processes the microphone signal; and a twisted pair conductor element coupling the microphone and the active noise reduction circuit, the twisted pair conductor element comprising a first conductive wire and a second conductive wire, wherein a first end of each of the first and second conductive wires is directly coupled to the active noise reduction sensing microphone, wherein a second end of each of the first and second conductive wires is directly coupled to the active noise reduction circuit, and wherein the twisted pair conductor element self-cancels a radio frequency (RF) field absent a ground reference.

8. The noise-cancelling headset of claim 7, wherein the twisted pair conductor element includes a non-shielded twisted pair cable or a partially shielded twisted pair cable.

9. The noise-cancelling headset of claim 7, wherein the twisted pair conductor element self-cancels the RF field to prevent the RF field from entering the active noise reduction sensing microphone.

10. The noise-cancelling headset of claim 9, wherein the twisted pair conductor element further produces a differential-mode signal that is canceled by the twisted pair conductor element to further self-cancel a radio frequency (RF) field and prevent the RF field from entering the active noise reduction sensing microphone.

11. The noise-cancelling headset of claim 7, wherein the second end of the first and second conductive wires is directly coupled to a terminal extending from a printed circuit board (PCB) of the active noise reduction circuit.

12. The noise-cancelling headset of claim 7, wherein the active noise reduction sensing microphone is at least one of a: condenser microphone, electret microphone, microelectromechanical (MEMS) microphone, dynamic microphone, carbon microphone, ribbon microphone and crystal microphone.

13. The noise-cancelling headset of claim 7, wherein the twisted pair conductor element has a twist rate or pitch constructed for reducing or eliminating stray RF fields that may otherwise be imposed on the active noise reduction sensing microphone.

14. A noise-cancelling headset, comprising:

an active noise reduction sensing microphone that detects an acoustic signal, and converts the acoustic signal into a microphone signal;

an active noise reduction circuit that receives and processes the microphone signal; and a twisted pair conductor element coupling the microphone and the active noise reduction circuit, wherein the twisted pair conductor element has a twist rate or pitch constructed for reducing or eliminating stray radio frequency (RF) fields that may otherwise be imposed on the microphone, and wherein the twisted pair conductor element self-cancels RF fields absent a ground reference.

15. The noise-cancelling headset of claim 14, wherein the twisted pair conductor element includes a non-shielded twisted pair cable or a partially shielded twisted pair cable.

16. The noise-cancelling headset of claim 14, wherein the twisted pair conductor element produces a differential-mode signal that is canceled by the twisted pair conductor element.

17. The noise-cancelling headset of claim 14, wherein at one end of the noise-cancelling headset, each conductive wire of the twisted pair conductive element is directly coupled to a terminal extending from the active noise reduction sensing microphone, and wherein at the other end of the noise-coupling headset, each conductive wire of the twisted pair conductive element is directly coupled to a terminal extending from a printed circuit board (PCB) of the active noise reduction circuit.

18. The noise-cancelling headset of claim 14, wherein the active noise reduction sensing microphone is at least one of a: condenser microphone, electret microphone, microelectromechanical (MEMS) microphone, dynamic microphone, carbon microphone, ribbon microphone and crystal microphone.

* * * * *